US011339993B2

(12) United States Patent
Zhao et al.

(10) Patent No.: US 11,339,993 B2
(45) Date of Patent: May 24, 2022

(54) MOUNTING BRACKET FOR WINDOW AIR CONDITIONER AND WINDOW AIR CONDITIONER ASSEMBLY

(71) Applicants: GD MIDEA AIR-CONDITIONING EQUIPMENT CO., LTD., Foshan (CN); MIDEA GROUP CO., LTD., Foshan (CN)

(72) Inventors: Ali Zhao, Foshan (CN); Zhigang Xing, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 359 days.

(21) Appl. No.: 16/497,890

(22) PCT Filed: Jul. 24, 2019

(86) PCT No.: PCT/CN2019/097481
§ 371 (c)(1),
(2) Date: Sep. 26, 2019

(87) PCT Pub. No.: WO2020/258431
PCT Pub. Date: Dec. 30, 2020

(65) Prior Publication Data

US 2021/0325054 A1 Oct. 21, 2021

(30) Foreign Application Priority Data

Jun. 26, 2019 (CN) ..... 201920979828.4

(51) Int. Cl.
*F24F 13/32* (2006.01)
*F24F 1/031* (2019.01)

(52) U.S. Cl.
CPC ..... *F24F 13/32* (2013.01); *F24F 1/031* (2019.02); *F24F 2221/20* (2013.01)

(58) Field of Classification Search
CPC .. F24F 13/32; F24F 1/0003; F24F 1/62; F24F 1/031; F24F 1/027; F24F 2221/20
See application file for complete search history.

(56) References Cited

U.S. PATENT DOCUMENTS 399,491 A * 3/1889 Bukawietis ..... A47L 3/02 182/62
2,320,436 A * 6/1943 Hull ..... F24F 1/0003 62/262

(Continued)

FOREIGN PATENT DOCUMENTS

CN 203404874 U 1/2014
CN 107327978 A 11/2017

(Continued)

OTHER PUBLICATIONS

Canadian Intellectual Property Office The Office Action For CA Application No. 3057125 dated Feb. 4, 2021 6 Pages.

(Continued)

*Primary Examiner* — Eret C McNichols
(74) *Attorney, Agent, or Firm* — Anova Law Group PLLC

(57) ABSTRACT

A mounting bracket includes a support frame and a stop member. The support frame includes a support rod and a leg connected to the support rod and angularly arranged relative to the support rod. The support rod includes a first end and a second end opposite each other. The stop member is located at the first end of the support rod and extends in a direction perpendicular to a length direction of the support rod.

19 Claims, 13 Drawing Sheets

(56) References Cited

U.S. PATENT DOCUMENTS 2,436,713 A * 2/1948 Cody ..... F24F 13/32 454/204
2,568,968 A * 9/1951 Perrin ..... E04G 3/18 248/236
2,608,148 A * 8/1952 Shapiro ..... F24F 13/32 454/204
2,814,244 A * 11/1957 Hord ..... F24F 1/04 454/203
2,925,026 A * 2/1960 Jamesh ..... F24F 1/04 454/203
2,935,284 A * 5/1960 Reeves ..... E04G 3/18 248/208
3,030,873 A * 4/1962 Metcalfe ..... F24F 1/04 454/204
3,134,319 A * 5/1964 Marsteller ..... F24F 13/20 454/203
3,476,033 A * 11/1969 Appel ..... F24F 13/20 454/203
3,481,264 A * 12/1969 Ulich ..... F24F 1/04 454/203
3,491,549 A * 1/1970 Oglesby ..... F24F 13/00 62/262
3,552,470 A * 1/1971 Metcalfe ..... F24F 1/04 160/26
3,554,476 A * 1/1971 Gaylor, Jr. ..... F24F 13/32 248/208
3,911,803 A * 10/1975 Kong ..... E06B 7/03 454/203
5,365,992 A * 11/1994 Swain ..... F24F 13/32 160/84.01
5,582,025 A * 12/1996 Dubin ..... F24F 1/0003 248/544
5,823,289 A * 10/1998 Csomos ..... E04G 3/18 182/61
5,979,533 A * 11/1999 Dupuie ..... F24F 1/0003 160/240
6,257,013 B1 * 7/2001 Murray ..... B60H 1/3229 62/302
6,767,278 B1 * 7/2004 Peterson ..... F24F 1/027 248/200.1
7,121,105 B1 * 10/2006 Rais ..... F24F 1/0003 62/262
7,296,424 B2 * 11/2007 Thompson ..... F24F 1/027 62/115
7,350,759 B1 * 4/2008 Gray ..... F24F 1/027 248/644
7,975,441 B2 * 7/2011 McCarriston ..... F24F 13/32 52/204.5
8,091,844 B1 * 1/2012 Bragg ..... F24F 13/32 248/208
8,104,240 B2 * 1/2012 McCarriston ..... F24F 13/32 52/204.5
8,584,998 B1 * 11/2013 Peterson ..... F24F 13/32 248/208
9,163,854 B2 * 10/2015 Arbucci ..... F24F 13/32
9,303,895 B1 * 4/2016 Grant ..... F24F 1/027
9,447,916 B2 * 9/2016 Darby ..... F16M 13/02
D782,289 S * 3/2017 Darby ..... D8/380
9,605,870 B2 * 3/2017 Darby ..... F16M 13/02
9,909,712 B1 * 3/2018 Darby ..... A47G 7/044
9,938,044 B2 * 4/2018 Gamboa ..... F24F 13/32
9,982,909 B1 * 5/2018 Perez ..... F24F 13/32
10,295,221 B2 * 5/2019 Zhang ..... F24F 13/32
10,401,043 B2 * 9/2019 Li ..... F24F 1/0003
10,520,206 B2 * 12/2019 Xu ..... F24F 13/32
2003/0097854 A1 * 5/2003 Cur ..... F24F 1/027 62/262
2007/0023592 A1 * 2/2007 Makoso ..... E06B 7/28 248/200.1
2007/0068185 A1 * 3/2007 Thompson ..... F24F 1/027 62/262
2007/0137237 A1 * 6/2007 Rais ..... F24F 1/027 62/262
2010/0229585 A1 * 9/2010 Bradford ..... F24F 1/34 62/291
2012/0137499 A1 * 6/2012 Agnihotri ..... F16M 13/02 29/462
2013/0153744 A1 * 6/2013 Jin ..... F24F 13/32 248/670
2014/0020421 A1 * 1/2014 Gallo ..... F24F 13/32 62/263
2014/0090334 A1 * 4/2014 Darby ..... E04G 3/18 52/741.1
2015/0034784 A1 * 2/2015 Darby ..... A47H 27/00 248/236
2015/0097096 A1 * 4/2015 Arbucci ..... E06B 7/28 248/208
2015/0107277 A1 * 4/2015 Moore ..... F24F 13/32 62/77
2017/0191763 A1 * 7/2017 Xu ..... F24F 1/027
2017/0284683 A1 * 10/2017 Gallo ..... F24F 13/0245
2017/0297768 A1 * 10/2017 Gamboa ..... B65D 85/68
2017/0328596 A1 * 11/2017 Darby ..... F24F 1/027
2018/0023842 A1 * 1/2018 Gardikis, Sr. ..... F24F 13/32 248/674
2019/0063760 A1 * 2/2019 Li ..... F24F 1/62
2020/0124296 A1 * 4/2020 Baumann ..... F24F 13/32
2020/0248911 A1 * 8/2020 Lei ..... F24F 13/32
2021/0010688 A1 * 1/2021 Biasotti ..... F24F 13/20
2021/0088251 A1 * 3/2021 Martinez Galvan .. F24F 1/0003
2021/0180828 A1 * 6/2021 Xing ..... F24F 13/32
2021/0325054 A1 * 10/2021 Zhao ..... F24F 1/031

FOREIGN PATENT DOCUMENTS

CN 208671190 U 3/2019
CN 208671324 U 3/2019
CN 209026964 U 6/2019
JP 4936738 U 4/1974
WO WO-2011085676 A1 * 7/2011 ..... F16M 11/10
WO WO-2020038239 A1 * 2/2020 ..... F24F 13/20
WO 2020258431 A1 12/2020

OTHER PUBLICATIONS

World Intellectual Property Organization (WIPO) International Search Report and Written Opinion for PCT/CN2019/097481 dated Mar. 25, 2020 21 Pages.

* cited by examiner

MOUNTING BRACKET FOR WINDOW AIR CONDITIONER AND WINDOW AIR CONDITIONER ASSEMBLY

CROSS-REFERENCE TO RELATED APPLICATIONS

This application is a National Stage Entry under 35 U.S.C. § 371 of International Application No. PCT/CN2019/097481, filed on Jul. 24, 2019, which is based on and claims priority to Chinese Patent Application Serial No. 201920979828.4, filed on Jun. 26, 2019, the entire contents of both which are incorporated herein by reference.

FIELD

The present disclosure relates a technical field of air processing apparatuses, and more particularly to a mounting bracket for a window air conditioner and a window air conditioner assembly.

BACKGROUND

In the related art, a window air conditioner is fixed in such a manner that the window air conditioner and a lower sash are fixed together through a screw so as to prevent the window air conditioner from dropping. A disadvantage of this installation and fixing manner for the window air conditioner is that once a user feels too stuffy at home and wants to open the window for ventilation, the window air conditioner will drop, that is, the window cannot be opened and used normally.

SUMMARY

Embodiments of the present disclosure seek to solve at least one of the technical problems existing in the related art. To this end, one objective of the present disclosure is to propose a mounting bracket for a window air conditioner. The mounting bracket facilitates mounting and fixing as well as safe and reliable use of the window air conditioner. When a lower sash is pulled upwardly, since the window air conditioner is supported on the mounting bracket, the window air conditioner will not drop due to disconnection from the lower sash, thereby achieving normal opening and use of the window.

The present disclosure further proposes a window air conditioner assembly having the above-described mounting bracket.

Embodiments according to a first aspect of the present disclosure provide a mounting bracket for a window air conditioner. The mounting bracket is configured to be mounted at a window opening in a wall, and the window air conditioner is adapted to be placed on the mounting bracket. The mounting bracket includes at least two support frames opposite each other and spaced apart in a left-and-right direction, each support frame including a support rod extending in a front-and-rear direction and a leg connected to an underside of the support rod, each support rod having a first end and a second end opposite each other in the front-and-rear direction, each leg having an upper end connected to the corresponding support rod and a lower end adapted to abut against an outer wall surface of the wall, and each leg being angularly arranged relative to the corresponding support rod; a stop member located at the first end of the support rod and extending upwardly; and a first connecting rod extending in the left-and-right direction, connected to respective second ends of two support rods, and adapted to be connected to an inner wall of the window opening or a window frame.

The mounting bracket according to embodiments of the present disclosure facilitates mounting and fixing of the window air conditioner and has a simple structure and high structural strength. When the lower sash is pulled upwardly, the mounting bracket can provide stable support for the window air conditioner, and the window air conditioner will not drop due to disconnection between the window air conditioner and the lower sash when the lower sash is opened. Hence, the lower sash can be normally opened upwardly. Furthermore, the first end of at least one support rod is provided with the stop member extending upwardly, such that the window air conditioner can be better prevented from dropping from the mounting bracket, thereby realizing safe and reliable use thereof. In addition, since the window air conditioner is placed on the mounting bracket, the normal opening and use of the window can be achieved.

According to some embodiments of the present disclosure, a length of each support rod is non-adjustable.

Optionally, at least one support rod is a one-piece member.

Optionally, at least one support rod includes a first sub-support rod and a second sub-support rod connected in the front-and-rear direction, and the first sub-support rod is fixed relative to the second sub-support rod.

According to some embodiments of the present disclosure, a surface of each support rod in contact with the window air conditioner is a support surface, the support surface of at least one support rod has a non-planar structure, and a base plate of the window air conditioner has a fitting part fitted with the support surface of the non-planar structure.

Optionally, the support surface of the non-planar structure includes a first sub-support surface and a second sub-support surface located in different planes, the first sub-support surface and the second sub-support surface are connected through a step surface, and the step surface extends obliquely in a direction from the first sub-support surface to the second sub-support surface.

According to some embodiments of the present disclosure, an angle formed between the leg and the corresponding support rod is non-adjustable.

According to some embodiments of the present disclosure, the first connecting rod is provided with a mounting lug horizontally extending towards the indoors, and the mounting bracket is adapted to be connected to a bottom wall of the window opening.

According to some embodiments of the present disclosure, the first connecting rod is adapted to abut against an inner side wall of the window frame.

According to some embodiments of the present disclosure, the first connecting rod is connected to the second ends of the two support rods through fasteners.

According to some embodiments of the present disclosure, the first connecting rod includes: a fixed rod adapted to be connected to a bottom wall of the window opening, the fixed rod being connected to the second ends of the two support rods and including a slide cavity having a rectangular cross section, the fixed rod including a plurality of first positioning holes spaced apart in a length direction of the fixed rod, and the plurality of first positioning holes being located in the same side wall of the slide cavity; and an adjustable rod provided to at least one end of the fixed rod in the length direction thereof, the adjustable rod at least partially extending into the slide cavity and being slidable relative to the fixed rod, the adjustable rod having a rectangular cross section, the adjustable rod including a plurality of second positioning holes spaced apart in a length direction of the adjustable rod, and the plurality of second positioning holes being located in the same side wall of the adjustable rod, and a positioning member being adapted to pass through the first positioning hole and the second positioning hole to fix the adjustable rod relative to the fixed rod.

Optionally, two ends of the fixed rod in the length direction thereof are each provided with the adjustable rod, an end of at least one adjustable rod away from the fixed rod is provided with an abutting plate, and a surface of the abutting plate away from the fixed rod is flush with an end surface of the adjustable rod away from the fixed rod.

Further, the end surface of the adjustable rod away from the fixed rod and the abutting plate are adapted to abut against a side wall of the window opening, and the abutting plate and the side wall of the window opening are adapted to be connected through a fastener.

According to some embodiments of the present disclosure, the mounting bracket includes a second connecting rod extending in the left-and-right direction and connected to respective first ends of the two support rods, and the stop member is disposed at the second connecting rod.

Embodiments according to a second aspect of the present disclosure provide a window air conditioner assembly. The window air conditioner assembly includes: a window air conditioner; and a mounting bracket according to embodiments of the first aspect of the present disclosure. The mounting bracket is configured to be mounted at a window opening in a wall, and the window air conditioner is placed on the mounting bracket.

In the window air conditioner assembly according to embodiments of the present disclosure, with the above-described mounting bracket, the window air conditioner can be mounted and fixed conveniently and have high safety and reliability, thereby realizing normal opening and use of the window.

Additional aspects and advantages of the present disclosure will be given in part in the following descriptions, become apparent in part from the following descriptions, or be learned from practicing the present disclosure.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
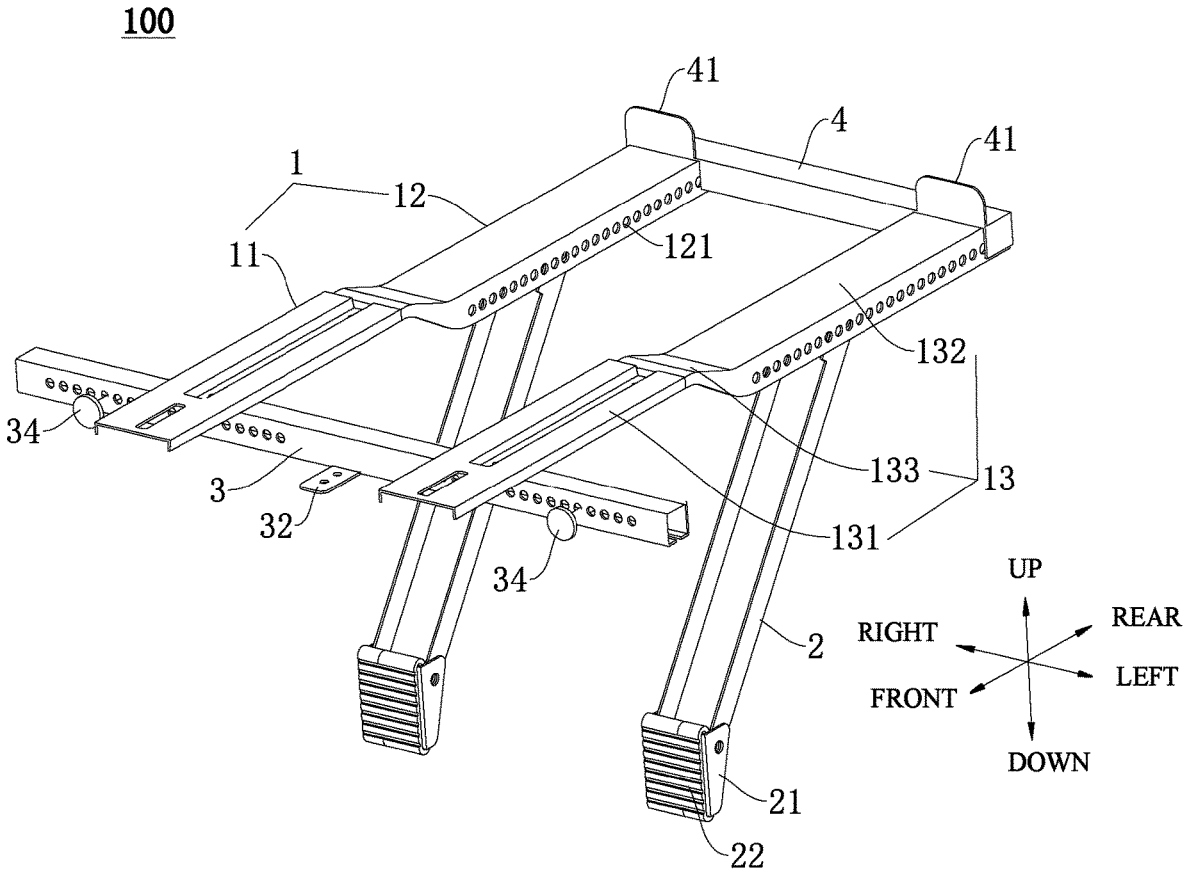
FIG. 1 is a perspective view of a mounting bracket according to some embodiments of the present disclosure.

REFERENCE NUMERALS mounting bracket 100;

support rod 1; first sub-support rod 11; second sub-support rod 12; first locking hole 121; support surface 13; first sub-support surface 131; second sub-support surface 132; step surface 133;

leg 2; support foot 21; rubber block 22;

first connecting rod 3; fixed rod 31; slide cavity 311; first positioning hole 312; mounting lug 32; adjustable rod 33; second positioning hole 331; abutting plate 332; fixing hole 3321; fastener 34;

second connecting rod 4; stop member 41;

window air conditioner 200; base plate 20; fitting part 2011;

wall 300; window opening 301; vertical frame part 401; horizontal frame part 402.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and only used to generally understand the present disclosure. The embodiments shall not be construed to limit the present disclosure.

A mounting bracket 100 for a window air conditioner according to embodiments of the present disclosure will be described below with reference to the drawings.

Figure 6:
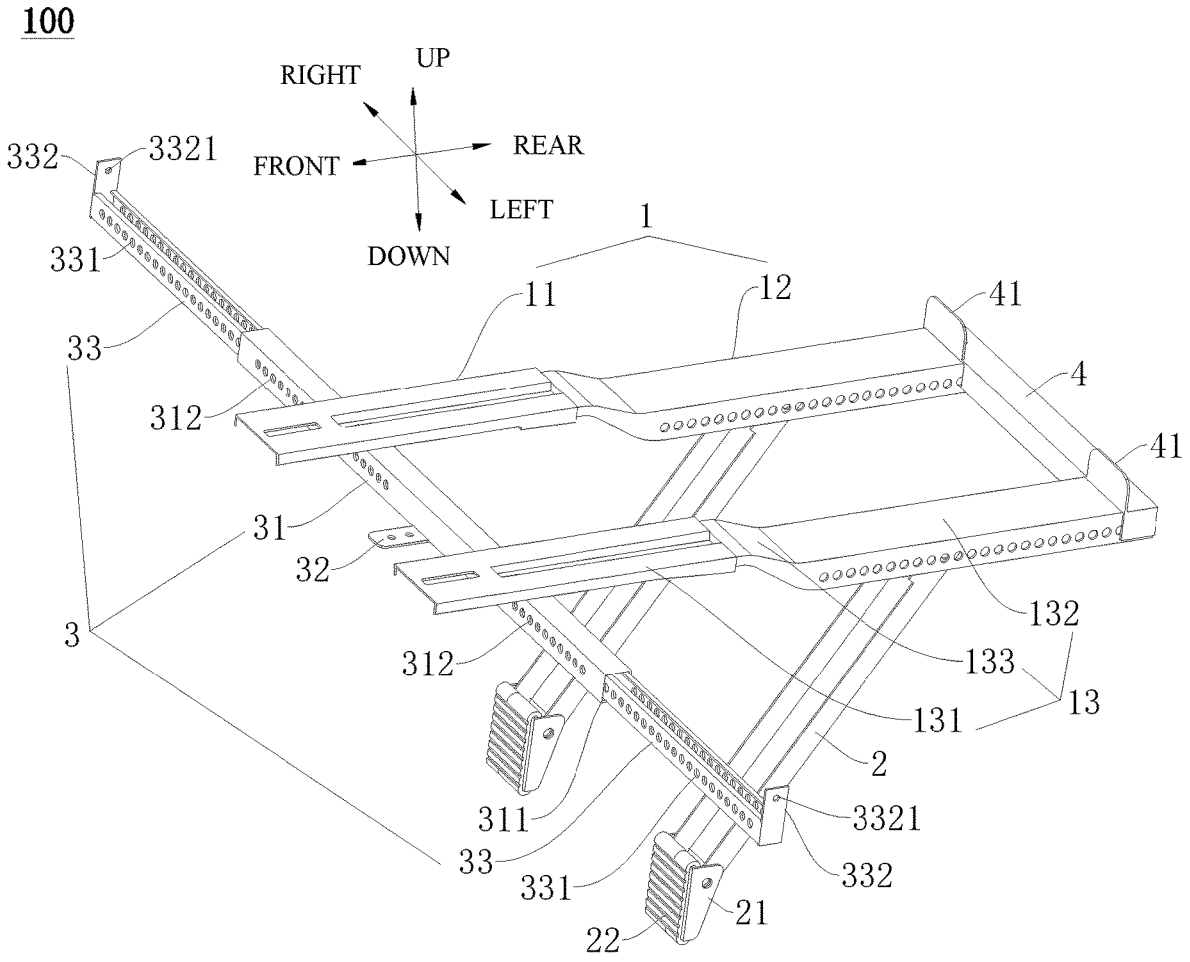
FIG. 6 is a perspective view of a mounting bracket according to some other embodiments of the present disclosure.
Figure 7:
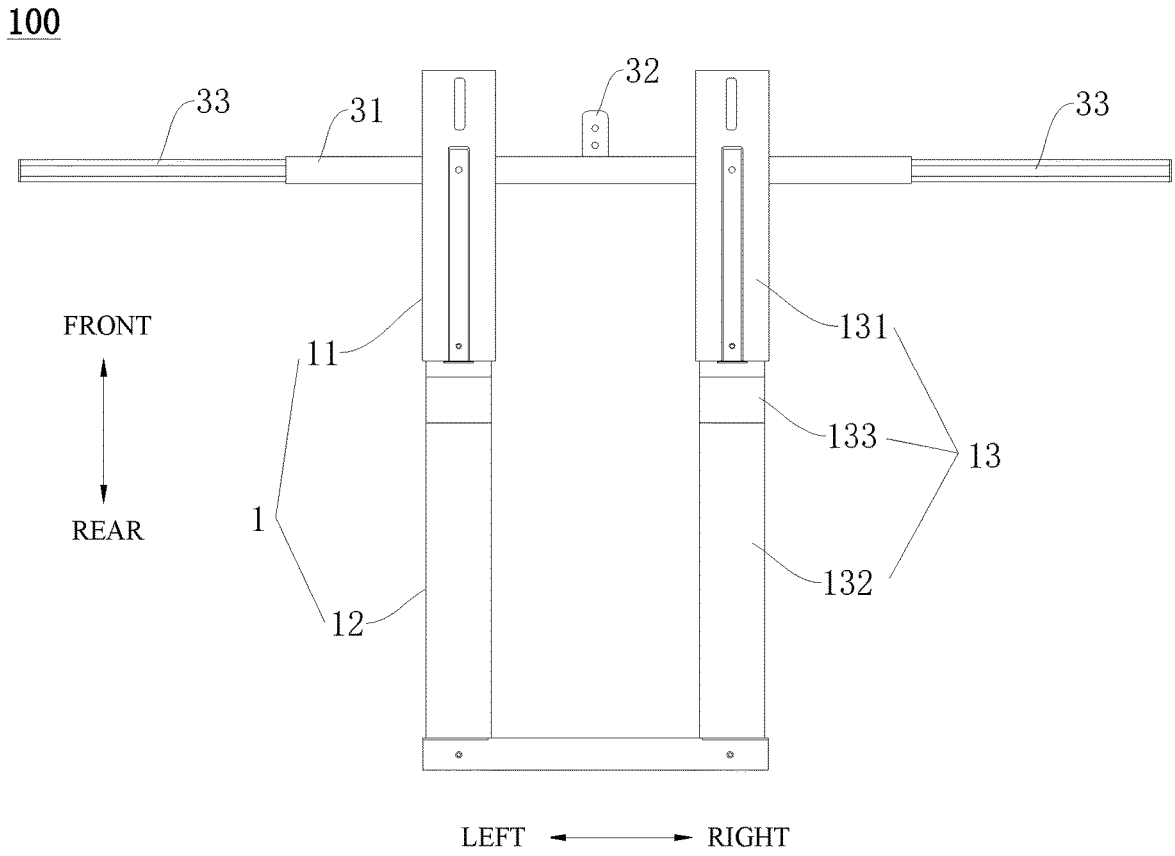
FIG. 7 is a main view of the mounting bracket of FIG. 6.
Figure 8:
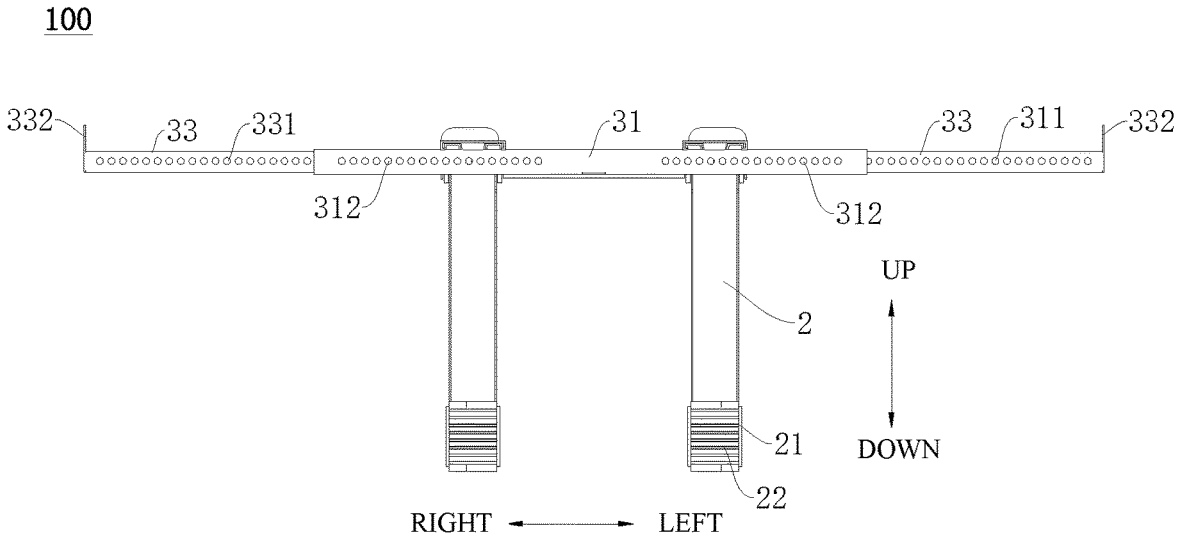
FIG. 8 is a side view of the mounting bracket of FIG. 6.
Figure 9:
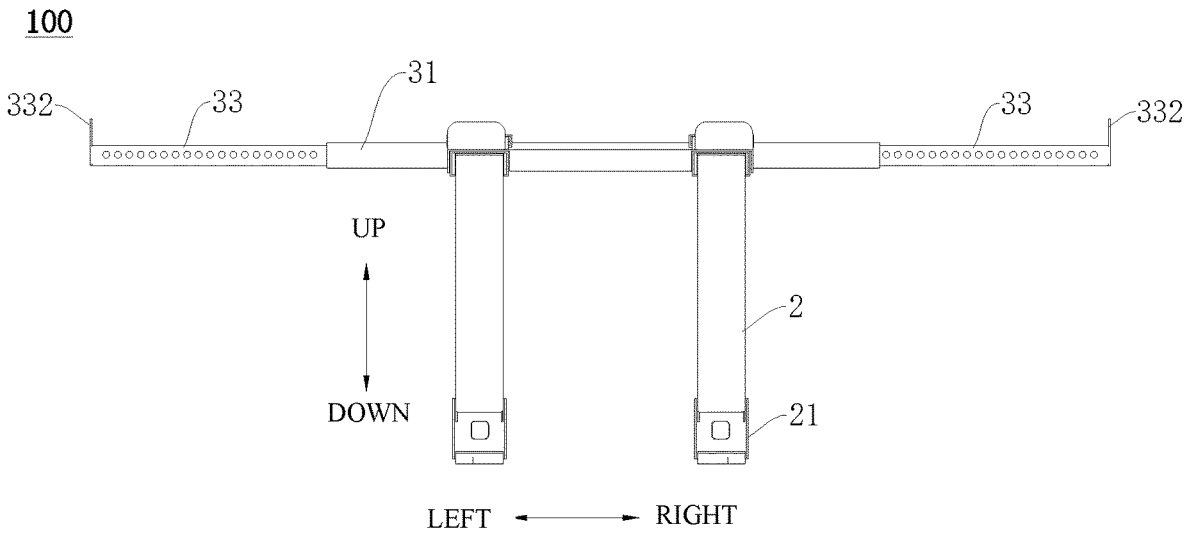
FIG. 9 is a side view of the mounting bracket of FIG. 6 from another angle.

As illustrated in FIGS. 1 and 6, in combination with FIGS. 11 to 14, the mounting bracket 100 according to embodiments of a first aspect of the present disclosure is configured to be mounted at a window opening 301 in a wall 300, an inner side wall of the window opening 301 may be mounted with a window frame 400, and a window air conditioner 200 is adapted to be placed on the mounting bracket 100.

The mounting bracket 100 includes at least two support frames opposite each other and spaced apart in a left-and-right direction, a stop member 41, and a first connecting rod 3. Each support frame includes a support rod 1 extending in a front-and-rear direction and a leg 2 connected to an underside of the support rod 1. Thus, with the mounting bracket 100 configured to include at least two support frames opposite each other and spaced apart in the left-and-right direction and the first connecting rod 3, the mounting bracket 100 can have improved structural strength and offer enough support to the window air conditioner 100. Each support rod 1 has a first end and a second end opposite each other in the front-and-rear direction, the stop member 41 is located at the first end of the support rod 1 and extends upwardly, and the stop member 41 may be in a flat plate shape. For example, the first end of only one of the support rods 1 can be provided with the stop member 41, or first ends of the two support rods 1 can be each provided with the stop member 41. Each leg 2 has an upper end connected to the corresponding support rod 1 and a lower end adapted to abut against an outer wall surface of the wall 300, and each leg 2 is angularly arranged relative to the corresponding support rod 1, such that each support frame forms a stable structure.

The first connecting rod 3 extends in the left-and-right direction, and connected to respective second ends of the two support rods 1. Optionally, the first connecting rod 3 is connected to the second ends of the two support rods 1 through fasteners, thus ensuring reliability of connection between the first connecting rod 3 and the two support rods 1. The first connecting rod 3 is adapted to be connected to a bottom wall of the window opening 301 or a window frame 400, and by connecting the first connecting rod 3 to an inner wall of the window opening 301 (the inner wall of the window opening 301 includes the bottom wall and the side wall of the window opening 301) or to the window frame 400, the mounting bracket 100 can be mounted and fixed at the window opening 301. Optionally, the first connecting rod 3 may be connected to the inner wall of the window opening 301 or the window frame 400 through a fastener (e.g., a screw). For example, the first connecting rod 3 may be connected to the inner wall of the window opening 301 through the fastener, the first connecting rod 3 may be connected to the window frame 400 through the fastener (e.g., the first connecting rod 3 is connected to a horizontal frame part 402 of the window frame 400 through the fastener), or the first connecting rod 3 may be connected to both of the inner wall of the window opening 301 and the window frame 400 through fasteners.

The mounting bracket 100 is configured with the above structure, such that the mounting bracket 100 can have a simple structure and high structural strength, and the mounting bracket 100 can sufficiently support the window air conditioner 200.

It should note that, the directions "front, rear, left, right, up, down" in the present disclosure refers to directions when a user faces the window air conditioner 200 after the mounting bracket 100 is mounted at the window opening 301 and the window air conditioner 200 is placed on the mounting bracket 100.

Figure 11:
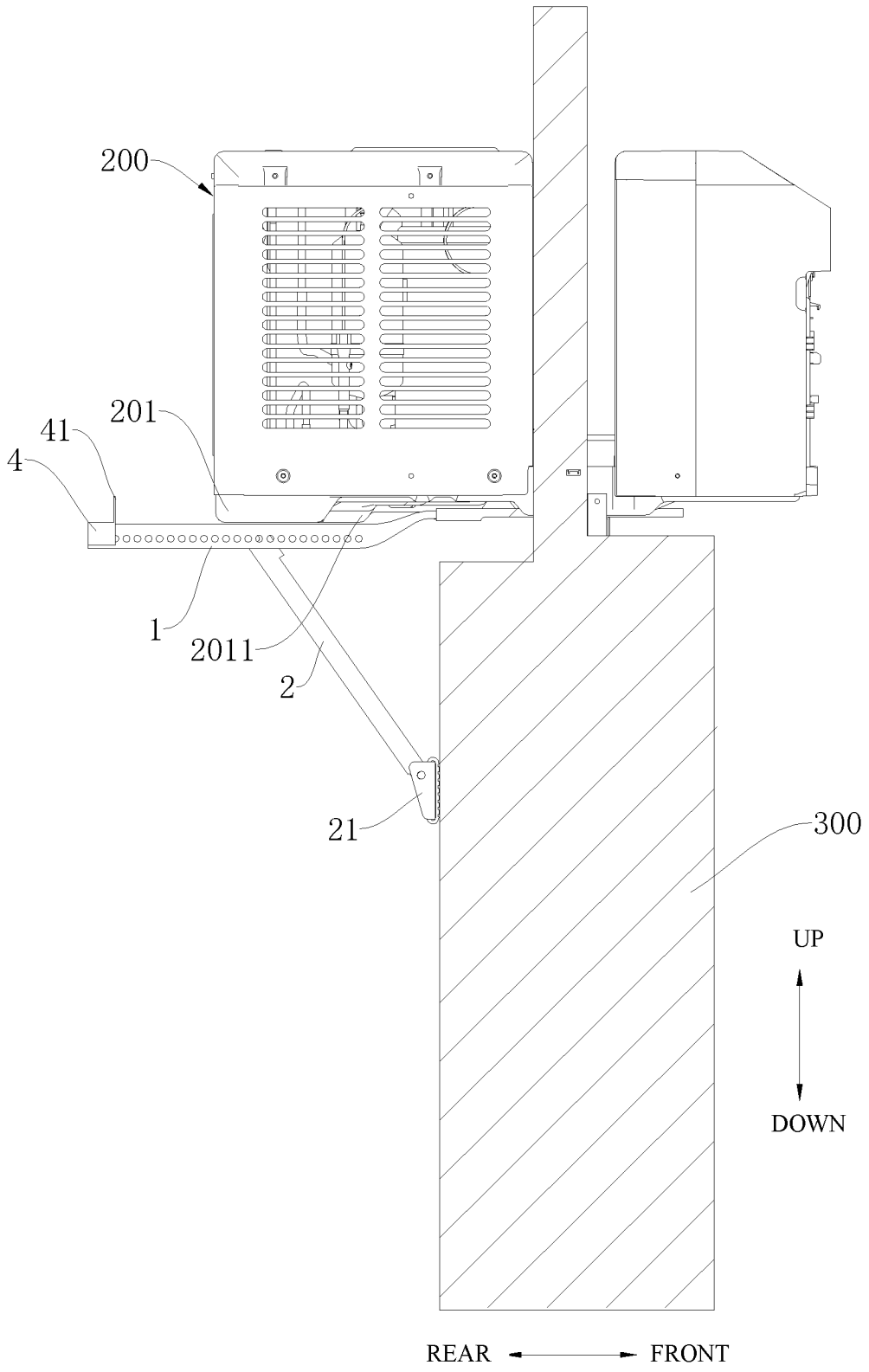
FIG. 11 is a schematic view showing fitting between a window air conditioner assembly and a window opening according to embodiments of the present disclosure.
Figure 12:
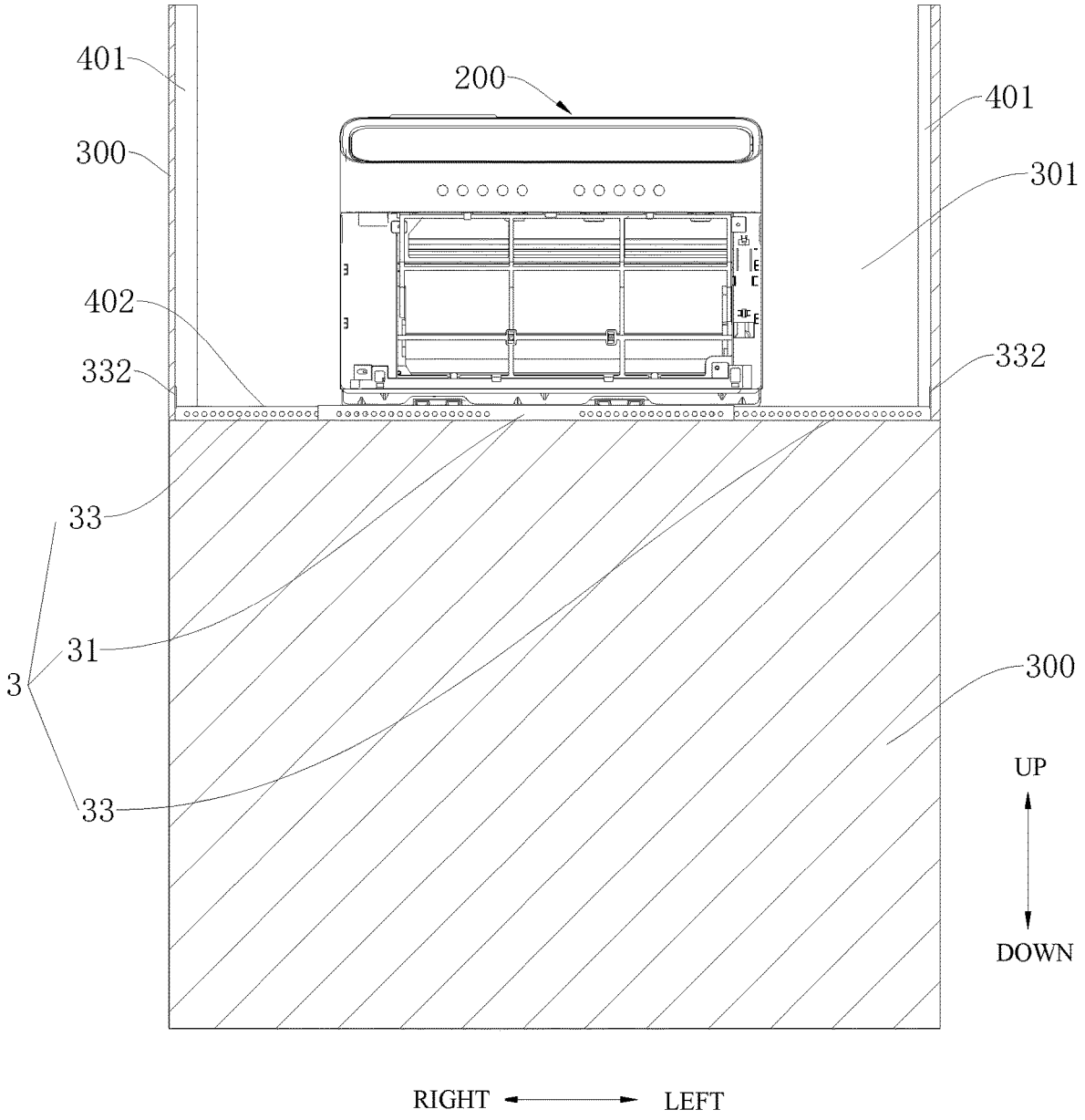
FIG. 12 is a schematic view showing fitting between a window air conditioner assembly and a window opening according to embodiments of the present disclosure from another angle, in which a free end of an adjustable rod abuts against both of a side wall of the window opening and a vertical frame part of a window frame.
Figure 13:
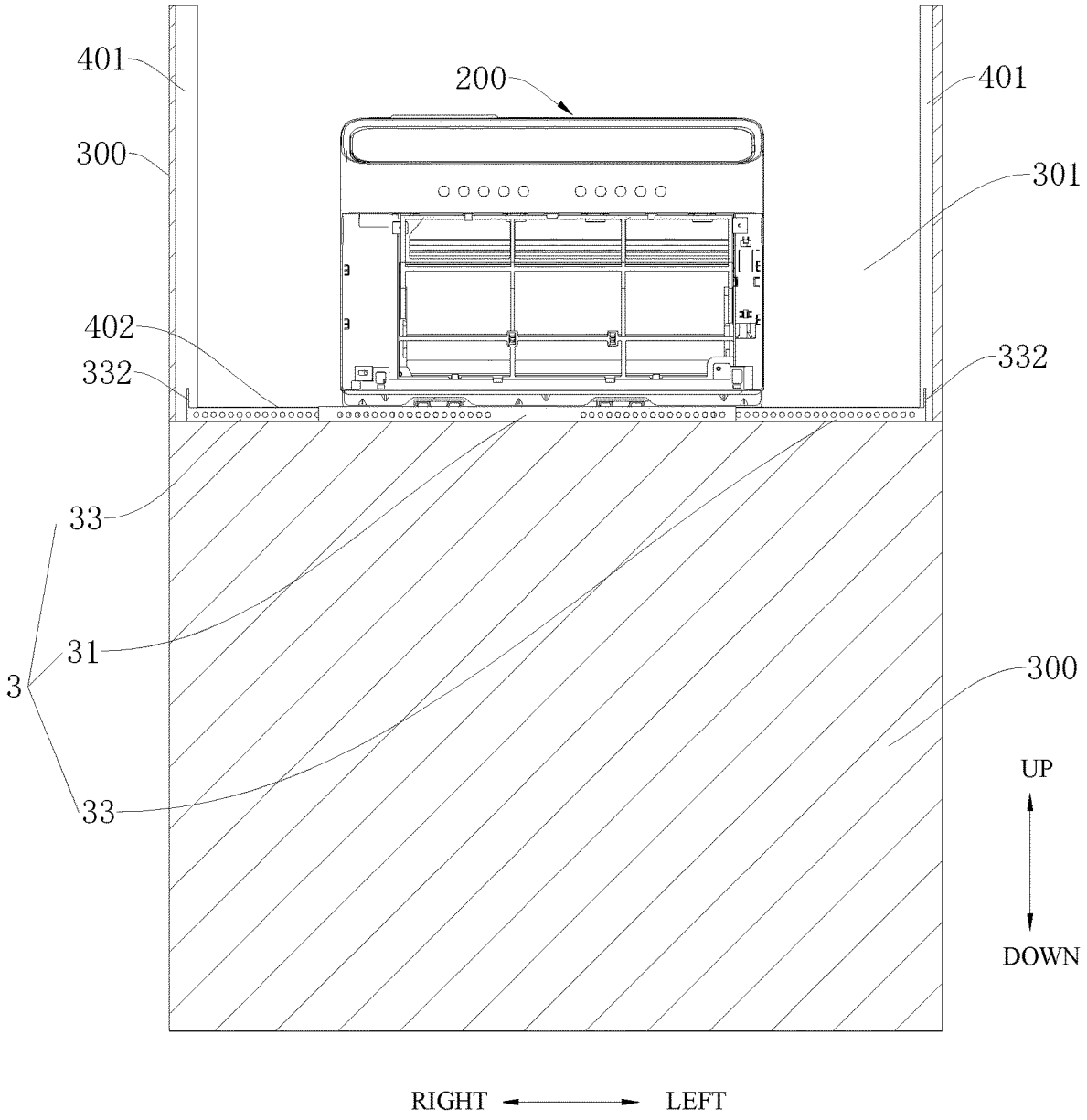
FIG. 13 is a schematic view showing fitting between a window air conditioner assembly and a window opening according to embodiments of the present disclosure from another angle, in which a free end of an adjustable rod abuts against a vertical frame part of a window frame and is spaced apart from a side wall of the window opening.
Figure 14:
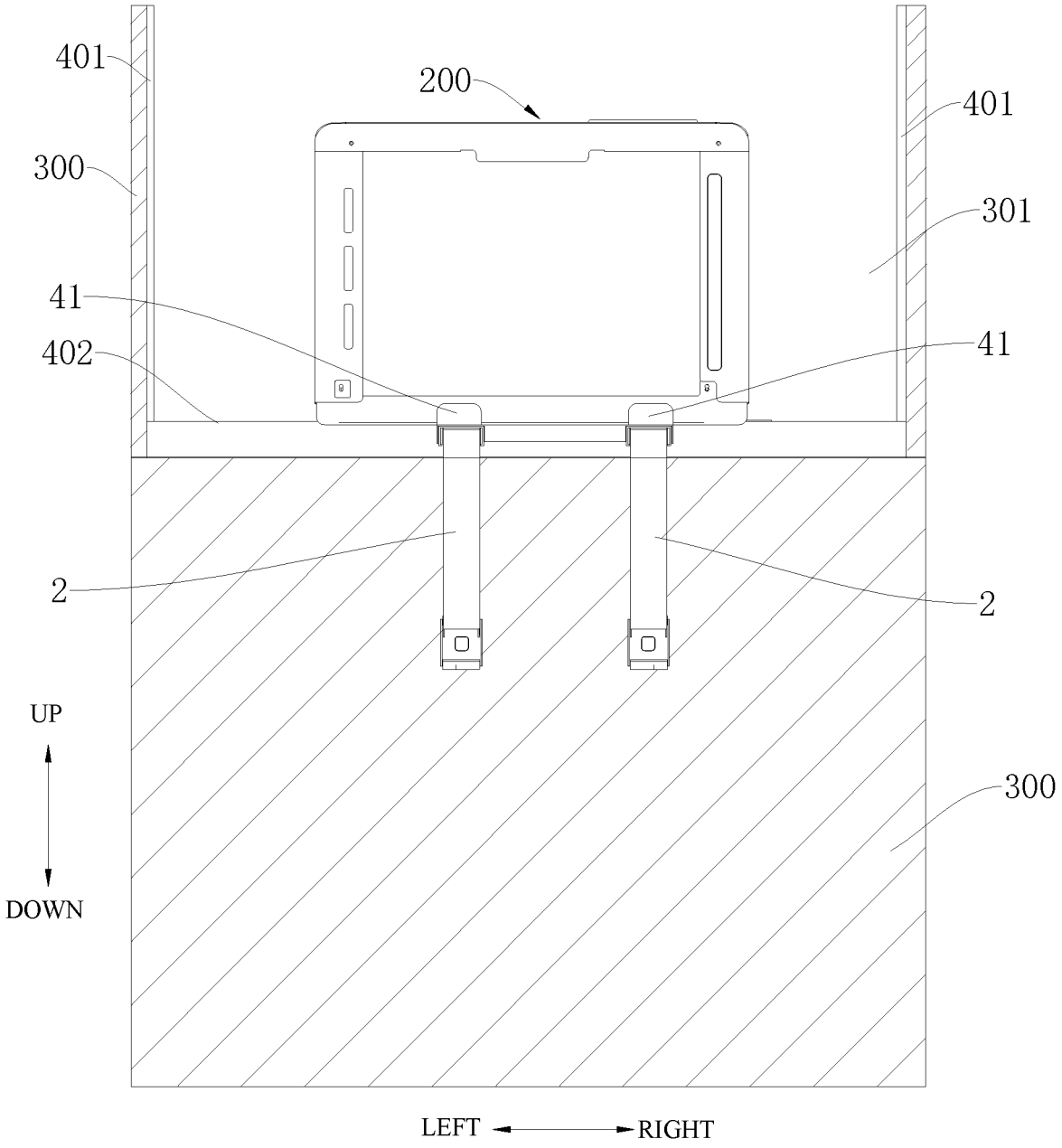
FIG. 14 is a schematic view showing fitting between a window air conditioner assembly and a window opening according to embodiments of the present disclosure from yet another angle.

As illustrated in FIGS. 11 to 13, when the mounting bracket 100 is mounted at the window opening 301, the first connecting rod 3 can be connected to a portion of the bottom wall of the window opening 301 located indoors, or the first connecting rod 3 can be disposed at the portion of the bottom wall of the window opening 301 located indoors and can be connected to the window frame 400. Two support rods 1 extend towards the outdoors, such that first ends of the two support rods 1 extend to the outdoors. Two support rods 1 can be supported on the bottom wall of the window opening 301, the lower end of each leg 2 abuts against the outer wall surface of the wall 300, and thus the mounting bracket 100 can be installed at the window opening 301. After the mounting bracket 100 is installed in place, the window air conditioner 200 can be placed on the mounting bracket 100, and a bottom surface of the window air conditioner 200 is mainly in contact with the two support rods 1, such that stable support for the window air conditioner 200 can be formed.

When a lower sash at the window opening 301 needs to be used, the lower sash is pulled upwardly, and the window air conditioner 200 is disconnected from the lower sash. Since the window air conditioner 200 is supported on the mounting bracket 100 and the mounting bracket 100 can provide stable support for the window air conditioner 200, the window air conditioner 200 will not drop due to disconnection between the window air conditioner 200 and the lower sash when the lower sash is opened, and the lower sash can be normally opened upwards.

Furthermore, when the window air conditioner 200 is placed on the mounting bracket 100, the stop member 41 disposed at the support rod 1 can have a limiting effect on the window air conditioner 200. For example, an outer wall surface of the window air conditioner 200 in the front-and-rear direction can abut against the stop member 41, thereby better preventing the window air conditioner 200 from dropping from the mounting bracket 100 and improving use safety and reliability of the mounting bracket 100.

Optionally, as illustrated in FIGS. 1, 5, 6 and 10, each leg 2 is movable (a translational movement) along a length direction of the corresponding support rod 1 (which is the front-and-rear direction in FIGS. 1 and 6). When the leg 2 moves to a set position, the leg 2 can be locked in the set position by a locking member such as a fastener 34, such that the leg 2 can be adjusted in the front-and-rear direction according to thicknesses of different walls 300, and the lower end of the leg 2 can abut against the outer wall surface of the wall 300, thereby improving universality of the mounting bracket 100. For example, each support rod 1 can be provided with a plurality of first locking holes 121 spaced apart in the length direction of the support rod 1, and the upper end of each leg 2 is provided with a second locking hole. When the leg 2 moves to different positions, the movement in the front-and-rear direction and the locking of the leg 2 can be conveniently achieved by the locking member provided through the first locking hole 121 and the second locking hole.

It should note that, "a plurality of" recited in the present disclosure refers to two or more than two.

Optionally, as illustrated in FIGS. 1, 3, 6 and 8, the lower end of each leg 2 has a support foot 21, and a surface of the support foot 21 in contact with the wall 300 may be a flat surface, thereby increasing a contact area between the lower end of the leg 2 and the wall 300, and improving the installation reliability of the mounting bracket 100. Further, the above-described support foot 21 can also be provided with a rubber block 22. When the support foot 21 abuts against the wall 300, the rubber block 22 abuts against the wall 300, and due to the elasticity of the rubber block 22, the contact between the support foot 21 and the wall 300 can be tighter.

The mounting bracket 100 according to embodiments of the present disclosure facilitates mounting and fixing of the window air conditioner 200, and has the simple structure and the high structural strength. When the lower sash is pulled upwardly, the mounting bracket 100 can provide stable support for the window air conditioner 200, the window air conditioner 200 will not drop due to disconnection between the window air conditioner 200 and the lower sash when the lower sash is opened, and thus the lower sash can be normally opened upwards. Furthermore, the first end of at least one support rod 1 is provided with the stop member 41 extending upwardly, such that the window air conditioner 200 can be better prevented from dropping from the mounting bracket 100, thereby realizing the safe and reliable use thereof. In addition, since the window air conditioner 200 is placed on the mounting bracket 100, the normal opening and use of the window can be achieved.

According to some embodiments of the present disclosure, a length of each support rod 1 is non-adjustable. Thus, the structural strength of the whole mounting bracket 100 can be enhanced, and the overall reliability of the mounting bracket 100 is improved.

In some optional embodiments of the present disclosure, at least one support rod 1 is a one-piece member. For example, only one of the support rods 1 may be a one-piece member, or both of the two support rods 1 may be one-piece members. Thus, the length of each support rod 1 can be non-adjustable, a production process for the support rod 1 can be simplified, and the overall structure of the mounting bracket 100 is firm and reliable.

In some optional embodiments of the present disclosure, as illustrated in FIGS. 1, 2, 6 and 7, at least one support rod 1 includes a first sub-support rod 11 and a second sub-support rod 12 connected to each other in the front-and-rear direction. The first sub-support rod 11 and the second sub-support rod 12 extend in the front-and-rear direction, the first sub-support rod 11 may be connected to the first connecting rod 3, and each leg 2 is connected to the second sub-support rod 12 of the corresponding support rod 1. For example, only one of the support rods 1 can include the first sub-support rod 11 and the second sub-support rod 12 connected to each other in the front-and-rear direction, or each support rod 1 can include the first sub-support rod 11 and the second sub-support rod 12 connected to each other in the front-and-rear direction. The first sub-support rod 11 and the second sub-support rod 12 are relatively fixed. For example, the first sub-support rod 11 and the second sub-support rod 12 may be connected through the fastener 34, or the first sub-support rod 11 and the second sub-support rod 12 may be connected by welding. By making the first sub-support rod 11 and the second sub-support rod 12 relatively fixed, it can be realized that the length of each support rod 1 is non-adjustable.

The support rod 1 is provided with a plurality of first locking holes 121 along the length direction of the support rod 1, and the plurality of first locking holes 121 can be formed in the second sub-support rod 12.

According to some embodiments of the present disclosure, as illustrated in FIGS. 1, 5, 6, 10 and 11, a surface of each support rod 1 in contact with the window air conditioner 200 is a support surface 13, and the support surface 13 of at least one support rod 1 is a non-planar structure. For example, the support surface 13 of only one of the support rods 1 can be set to be a non-planar structure, or the support surface 13 of each support rod 1 can be set to be a non-planar structure. A base plate 201 of the window air conditioner 200 has a fitting part 2011 fitted with the support surface 13 of the non-planar structure. Thus, friction between the window air conditioner 200 and the support surface 13 of the support rod 1 can be increased, a dropping risk of the window air conditioner 200 can be further reduced, and the safety and reliability of the mounting bracket 100 can be further improved.

Optionally, as illustrated in FIGS. 1, 5, 6 and 10, the support surface 13 of the non-planar structure includes a first sub-support surface 131 and a second sub-support surface 132 located in different planes. The first sub-support surface 131 and the second sub-support surface 132 are connected through a step surface 133, and the step surface 133 extends obliquely in a direction from the first sub-support surface 131 to the second sub-support surface 132. Thus, with the support surface 13 of the support rod 1 configured to be a structure having the step surface 133, the window air conditioner 200 can be better prevented from slipping off the mounting bracket 100. For example, in combination with FIG. 11, the base plate 201 of the window air conditioner 200 has the fitting part 2011 fitted with the support surface 13 of the support rod 1, and the fitting part 2011 has a step structure, thereby better preventing the window air conditioner 200 from slipping off the mounting bracket 100. Furthermore, since the base plate 201 of the window air conditioner 200 has the fitting part 2011 of the above-described step structure, the interior of the base plate 201 can have a large installation space.

According to some embodiments of the present disclosure, as illustrated in FIGS. 1 and 6, an angle formed between the leg 2 and the corresponding support rod 1 is non-adjustable, that is, the angle formed between the leg 2 and the corresponding support rod 1 remains constant. Thus, the leg 2 can be prevented from rotating relative to the corresponding support rod 1, and firmness and reliability of the mounting bracket 100 can be further improved. Optionally, the upper end of the leg 2 and the corresponding support rod 1 can be connected through the fastener.

According to some embodiments of the present disclosure, as illustrated in FIGS. 1, 2, 6 and 7, the first connecting rod 3 is provided with a mounting lug 32 horizontally extending towards the indoors, and the mounting lug 32 is adapted to be connected to the bottom wall of the window opening 301. Thus, with the first connecting rod 3 having the mounting lug 32 extending horizontally, the connection between the first connecting rod 3 and the bottom wall of the window opening 301 is facilitated, and the reliable connection between the first connecting rod 3 and the bottom wall of the window opening 301 can be achieved.

According to some embodiments of the present disclosure, as illustrated in FIGS. 1, 6 and 12-14, the first connecting rod 3 is adapted to abut against an inner side wall of the window frame 400 (the inner side wall of the window frame 400 refers to a side wall of the window frame 400 facing the indoors). For example, the first connecting rod 3 abuts against an inner side wall of a horizontal frame part 402 of the window frame 400. Thus, the reliability of installation and fixing of the first connecting rod 3 can be further improved, and the use safety of the mounting bracket 100 can be further enhanced.

Figure 2:
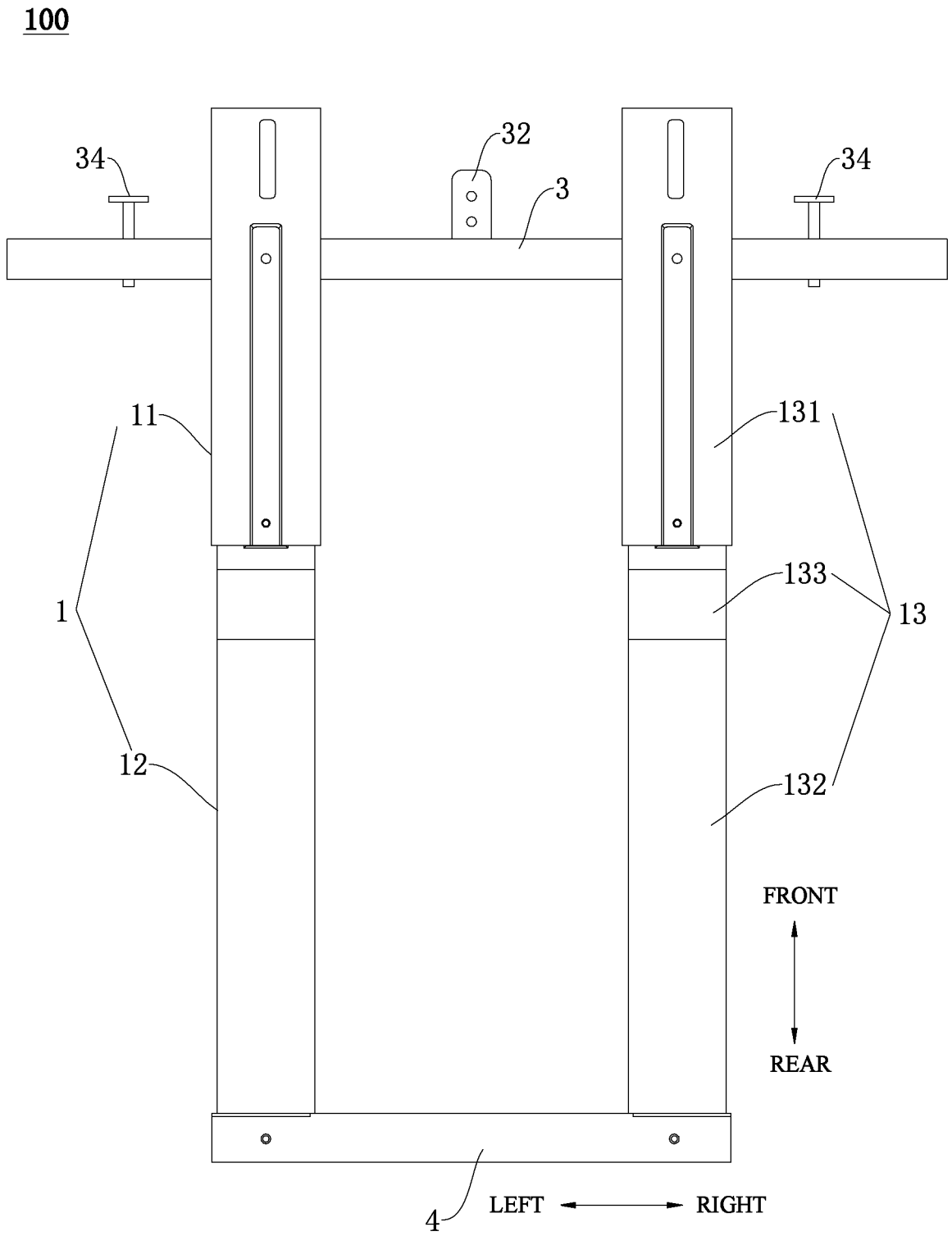
FIG. 2 is a main view of the mounting bracket of FIG. 1.
Figure 3:
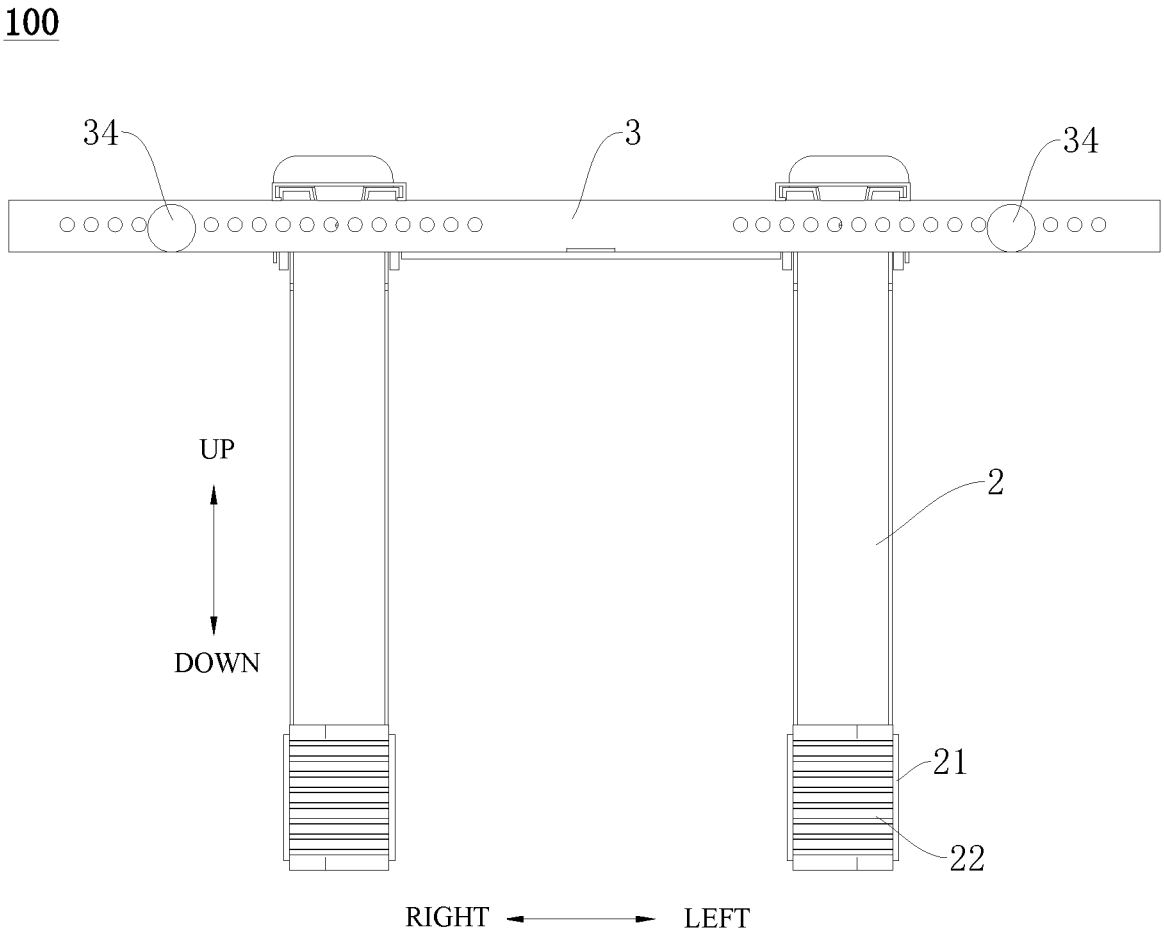
FIG. 3 is a side view of the mounting bracket of FIG. 1.
Figure 4:
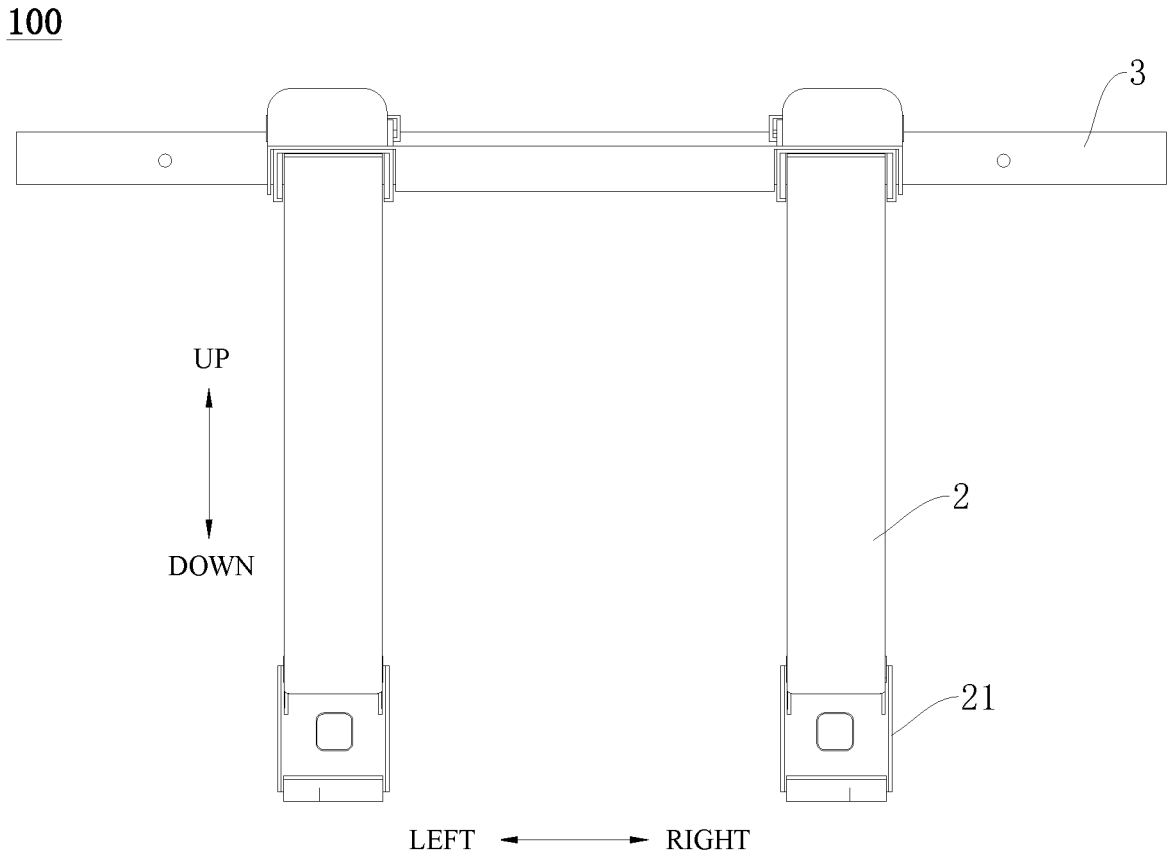
FIG. 4 is a side view of the mounting bracket of FIG. 1 from another angle.
Figure 5:
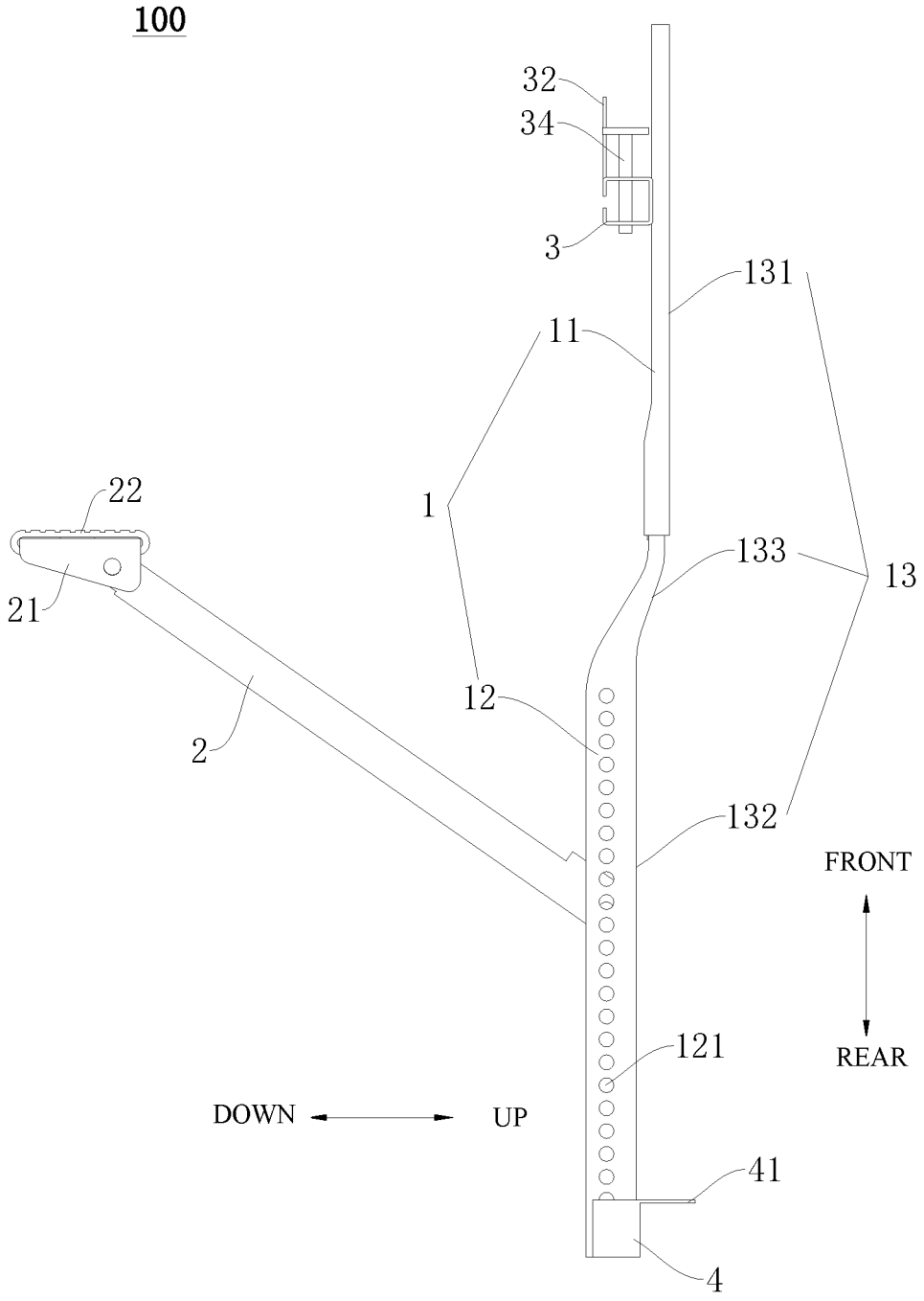
FIG. 5 is a side view of the mounting bracket of FIG. 1 from yet another angle.

For example, in an example illustrated in FIGS. 1 and 2, the length of the first connecting rod 3 is non-adjustable, and the first connecting rod 3 and the mounting lug 32 are formed as one piece. The first connecting rod 3 is mounted to the portion of the bottom wall of the window opening 301 located indoors, the first connecting rod 3 is provided with the mounting lug 32 horizontally extending towards the indoors, and the mounting lug 32 is adapted to be connected to the bottom wall of the window opening 301. Meanwhile, the first connecting rod 3 abuts against the inner side wall of the horizontal frame part 402 of the window frame 400, and the first connecting rod 3 itself can be connected to the horizontal frame part 420 of the window frame 400 through the fastener 34. Thus, the reliability of installation and fixing of the first connecting rod 3 can be further improved, and the reliability of installation and fixing of the mounting bracket 100 can be further improved.

According to some embodiments of the present disclosure, as illustrated in FIGS. 6 to 9, the first connecting rod 3 includes a fixed rod 31 and an adjustable rod 33. The fixed rod 31 is adapted to be connected to the bottom wall of the window opening 301 or the window frame 400. For example, the fixed rod 31 may be connected to the bottom wall of the window opening 301 through a fastener, the fixed rod 31 may be connected to the window frame 400 through a fastener (e.g., the fixed rod 31 is connected to the horizontal frame part 401 of the window frame 400 through the fastener), or the fixed rod 31 may be connected to both of the bottom wall of the window opening 301 and the window frame 400 through fasteners. The fixed rod 31 is connected to respective second ends of two support rods 1 and includes a slide cavity 311 having a rectangular cross section. The fixed rod 31 is provided with a plurality of first positioning holes 312 spaced apart in a length direction of the fixed rod 31, and the plurality of first positioning holes 312 are located in the same side wall of the slide cavity 311.

The adjustable rod 33 is disposed at at least one end of the fixed rod 31 in the length direction thereof (which is the left-and-right direction in FIGS. 6-9). For example, the adjustable rod 33 may be disposed at only one end of the fixed rod 31 in the length direction thereof, or the adjustable rod 33 may also be disposed at each end of the fixed rod 31 in the length direction thereof. The adjustable rod 33 at least partially extends into the slide cavity 311 and is slidable relative to the fixed rod 31 along the length direction of the fixed rod 31, and the adjustable rod 33 has a rectangular cross section. The adjustable rod 33 is provided with a plurality of second positioning holes 331 spaced apart in a length direction of the adjustable rod 33 (which is the left-and-right direction in FIGS. 6-9), and the plurality of second positioning holes 331 are located in the same side wall of the adjustable rod 33. A positioning member is adapted to pass through the first positioning hole 312 and the second positioning hole 331 to make the adjustable rod 33 fixed relative to the fixed rod 31.

Thus, with the adjustable rod 33 being slided, an overall length of the first connecting rod 3 can be adjusted, and left and right ends of the first connecting rod 3 (i.e., free ends of two adjustable rods 33 located at left and right sides) can abut against left and right side walls of the window opening 301 in the left-and-right direction, respectively. Meanwhile, the left and right ends of the first connecting rod 3 abut against a vertical frame part 401 of the window frame in the front-and-rear direction (refer to FIG. 12), thereby further improving the reliability of installation and fixing of the first connecting rod 3. Furthermore, with a stretching length of the adjustable rod 33 being adjusted, the first connecting rod 3 can adapt for the window openings 301 of different sizes, thereby improving the universality of the mounting bracket 100.

Certainly, when the mounting bracket 100 is in use, with the overall length of the first connecting rod 3 being adjusted, the left and right ends of the first connecting rod 3 (i.e., free ends of two adjustable rods 33 located at left and right sides) can also abut against the vertical frame part 401 of the window frame in the front-and-rear direction, and the left and right ends of the first connecting rod 3 can be spaced apart from the left and right side walls of the window opening 301 in the left-and-right direction respectively (referring to FIG. 13), thereby also improving the reliability of installation and fixing of the first connecting rod 3.

In addition, in a case that the cross section of the slide cavity 311 and the cross section of the adjustable rod 33 are configured to be rectangular, when the adjustable rod 33 slides relative to the fixed rod 31, the adjustable rod 33 can be prevented from rotating relative to the fixed rod 31, and the first positioning hole 312 of the fixed rod 31 can be conveniently aligned with the second positioning hole 331 of the adjustable rod 33, thereby facilitating a locking operation of the adjustable rod 33.

Optionally, as illustrated in FIGS. 6-9 and 12, each end of the fixed rod 31 in the length direction thereof is provided with the adjustable rod 33, an end of at least one adjustable rod 33 away from the fixed rod 31 is provided with an abutting plate 332 extending upwardly, and a surface of the abutting plate 332 away from the fixed rod 31 is flush with an end surface of the adjustable rod 33 away from the fixed rod 31. For example, an end of only one of the adjustable rods 33 away from the fixed rod 31 is provided with the abutting plate 332 extending upwardly, or an end of each adjustable rod 33 away from the fixed rod 31 is provided with the abutting plate 332 extending upwardly. Thus, with the above-described abutting plate 332, when the first connecting rod 3 is adjusted to be substantively consistent with a size of the window opening 301 in the left-and-right direction, the left and right end surfaces of the first connecting rod 3 can abut against side walls of the window opening 301 while the abutting plate 332 can also abut against the side wall of the window opening 301. Furthermore, the left and right ends of the first connecting rod 3 abut against the vertical frame part 401 of the window frame in the front-and-rear direction, such that abutting areas between the left and right ends of the first connecting rod 3 and the side walls of the window opening 301 as well as the window frame can be enlarged, thereby improving the reliability of installation and fixing of the mounting bracket 100.

For example, in an example illustrated in FIGS. 6-9, the first connecting rod 3 includes the above-described fixed rod 31 and two adjustable rods 33, the two adjustable rods 33 are disposed at the left and right ends of the fixed rod 31 respectively, and each adjustable rod 33 is slidable relative to the fixed rod 31 in the left-and-right direction, such that the length of the first connecting rod 3 is adjustable. Specifically, the fixed rod 31 includes the slide cavity 311 having the rectangular cross section, each adjustable rod 33 has a rectangular cross section, and each adjustable rod 33 at least partially extends into the slide cavity 311 and is slidable relative to the fixed rod 31 in the left-and-right direction. A side of the fixed rod 31 away from the support rod 1 is provided with the mounting lug 32 extending horizontally, and an end of each adjustable rod 33 away from the fixed rod 31 is provided with the abutting plate 332 extending upwardly.

When the mounting bracket 100 is mounted at the window opening 301, the mounting lug 32 can be connected to the bottom wall of the window opening 301 through the fastener, and a connection structure between the fixed rod 31 and the window frame can be omitted (for example, the fastener between the first connecting rod 3 itself and the horizontal frame part 402 of the window frame in the above embodiment can be omitted). The adjustable rod 33 is adjusted to cause a left end surface of the adjustable rod 33 at the left end and the corresponding abutting plate 332 to abut against the left side wall of the window opening 301, and cause a right end surface of the adjustable rod 33 at the right end and the corresponding abutting plate 332 to abut against the right side wall of the window opening 301, such that the mounting bracket 100 can be reliably mounted and fixed at the window opening 301, and the operation of connecting the fixed rod 31 itself with the horizontal frame part 402 of the window frame through the fastener can be omitted.

Figure 10:
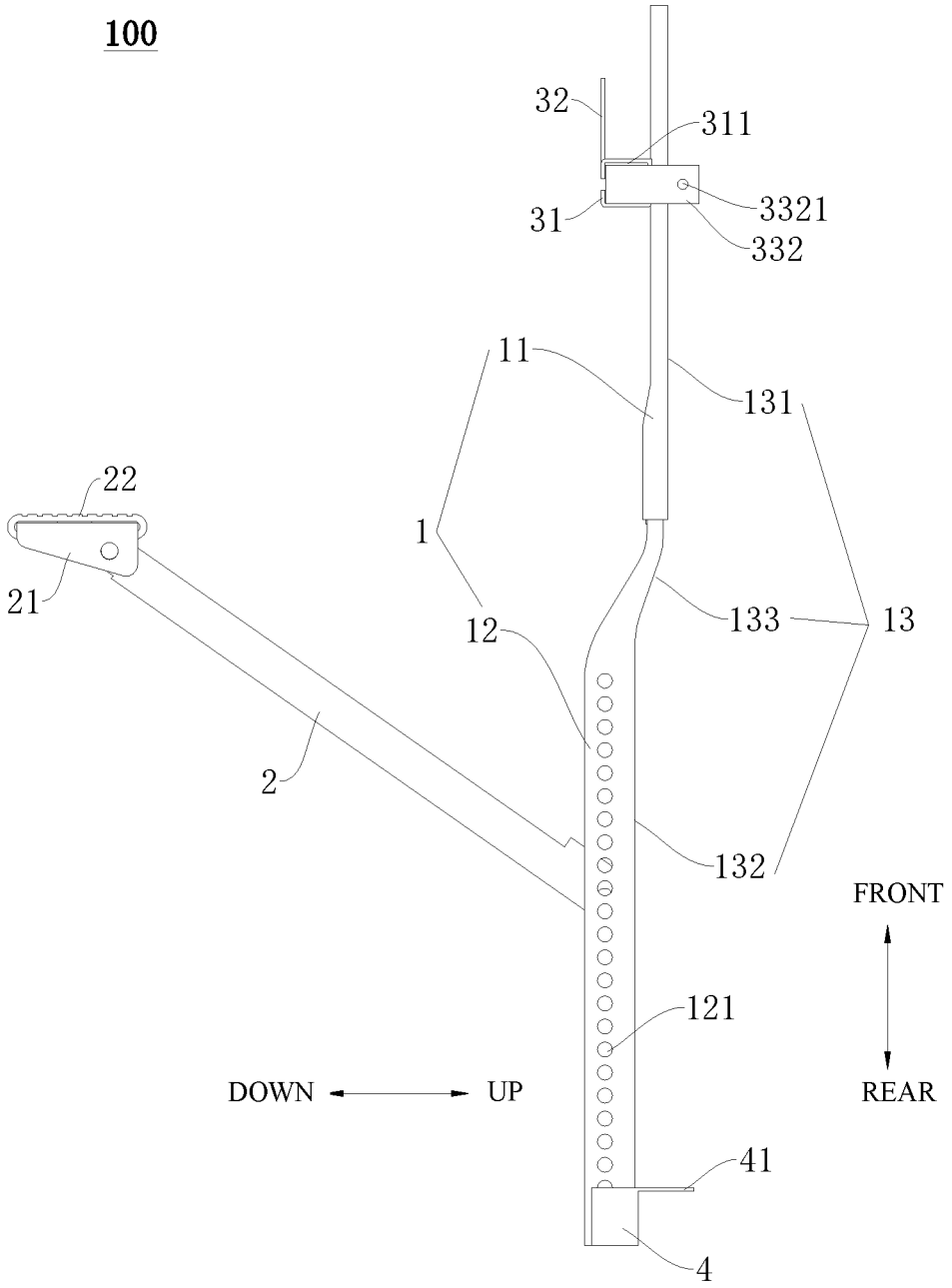
FIG. 10 is a side view of the mounting bracket of FIG. 6 from yet another angle.

Further, as illustrated in FIGS. 6 and 10, each abutting plate 332 may include a fixing hole 3321. The user can connect the abutting plate 332 and the side wall of the window opening 301 using the fastener, or abut the abutting plate 332 directly against the side wall of the window opening 301, according to needs.

According to some embodiments of the present disclosure, as illustrated in FIGS. 1, 2, 6 and 7, the mounting bracket 100 includes a second connecting rod 4. The second connecting rod 4 extends in the left-and-right direction, and is connected to respective first ends of the two support rods 1. The stop member 41 is disposed at the second connecting rod 4. Thus, with the second connecting rod 4, the structural strength of the mounting bracket 100 can be enhanced; and with the stop member 41 provided at the second connecting rod 4, the stop member 41 can be conveniently disposed at the first end of the support rod 1.

Optionally, the stop member 41 and the second connecting rod 4 are formed as one piece. Thus, the production process of the mounting bracket 100 can be simplified.

As illustrated in FIGS. 11 to 13, a window air conditioner 200 assembly according to embodiments of a second aspect of the present disclosure includes: a window air conditioner 200; and a mounting bracket 100 according to the above-described embodiments of the first aspect of the present disclosure, in which the mounting bracket 100 is configured to be mounted at a window opening 301 in a wall 30, and the window air conditioner 200 is placed on the mounting bracket 100.

In the window air conditioner 200 assembly according to embodiments of the present disclosure, with the above-described mounting bracket 100, the window air conditioner 200 can be mounted and fixed conveniently and have high safety and reliability, thereby realizing normal opening and use of the window.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variants without departing from the principle of the present disclosure are acceptable. The scope of the present invention is defined by the claims or the like.

What is claimed is:

1. A mounting bracket comprising:

a support frame comprising:

a support rod including a first end and a second end opposite each other; and a leg angularly arranged relative to the support rod, one end of the leg being connected to the support rod;

a stop member located at the first end of the support rod and extending in a direction perpendicular to a length direction of the support rod; and a connecting rod extending in a direction perpendicular to the length direction of the support rod and an extension direction of the stop member, the connecting rod including a mounting lug extending along the length direction of the support rod.

2. The mounting bracket according to claim 1, wherein a length of the support rod is non-adjustable.

3. The mounting bracket according to claim 2, wherein the support rod comprises a first sub-support rod and a second sub-support rod connected in the length direction of the support rod, and the first sub-support rod is fixed relative to the second sub-support rod.

4. The mounting bracket according to claim 1, wherein a support surface of the support rod on a side opposite a side connected to the leg is non-planar.

5. The mounting bracket according to claim 4, wherein the support surface comprises a first sub-support surface and a second sub-support surface located in different planes, and the first sub-support surface and the second sub-support surface are connected through a step surface extending obliquely relative to the planes.

6. The mounting bracket according to claim 1, wherein an angle between the leg and the support rod is non-adjustable.

7. The mounting bracket according to claim 1, wherein:

the connecting rod is connected to the second end of the support rod.

8. The mounting bracket according to claim 7, wherein the connecting rod is connected to the second end of the support rod through a fastener.

9. The mounting bracket according to claim 7, wherein the connecting rod comprises:

a fixed rod connected to the second end of the support rod and including a slide cavity; and an adjustable rod provided at one end of the fixed rod in a length direction of the fixed rod, the adjustable rod at least partially extending into the slide cavity and being slidable relative to the fixed rod.

10. The mounting bracket according to claim 9, wherein both the slide cavity and the adjustable rod have a rectangular cross section.

11. The mounting bracket according to claim 9, wherein:

the fixed rod includes a plurality of first positioning holes spaced apart in the length direction of the fixed rod and located in a same side wall of the slide cavity;

the adjustable rod includes a plurality of second positioning holes spaced apart in a length direction of the adjustable rod and located in a same side wall of the adjustable rod; and the connecting rod further includes a positioning member configured to pass through one of the first positioning holes and one of the second positioning holes to fix the adjustable rod relative to the fixed rod.

12. The mounting bracket according to claim 9, wherein:

the adjustable rod is a first adjustable rod; and the connecting rod further includes a second adjustable rod provided at another end of the fixed rod in the length direction of the fixed rod, the second adjustable rod at least partially extending into the slide cavity and being slidable relative to the fixed rod.

13. The mounting bracket according to claim 9, wherein:

an end of the adjustable rod away from the fixed rod is provided with an abutting plate; and a surface of the abutting plate away from the fixed rod is flush with an end surface of the adjustable rod away from the fixed rod.

14. The mounting bracket according to claim 7, wherein the connecting rod is a first connecting rod;

the mounting bracket further comprising:

a second connecting rod extending in the direction perpendicular to the length direction of the support rod and the extension direction of the stop member and connected to the first end of the support rod, the stop member being disposed at the second connecting rod.

15. The mounting bracket according to claim 14, wherein the stop member and the second connecting rod are formed as one piece.

16. The mounting bracket according to claim 7, wherein:

the support frame is one of two support frames of the mounting bracket that are spaced apart from each other in a length direction of the connecting rod, the two support frames having a similar structure; and the connecting rod is connected to the second ends of the support rods of the two support frames.

17. A window air conditioner assembly comprising:

a window air conditioner; and a mounting bracket configured to support the window air conditioner, the mounting bracket including:

a support frame comprising:

a support rod including a first end and a second end opposite each other; and a leg angularly arranged relative to the support rod, one end of the leg being connected to the support rod;

a stop member located at the first end of the support rod and extending in a direction perpendicular to a length direction of the support rod; and a connecting rod extending in a direction perpendicular to the length direction of the support rod and an extension direction of the stop member, the connecting rod including a mounting lug extending along the length direction of the support rod.

18. The window air conditioner assembly of claim 17, wherein:

the connecting rod is connected to the second end of the support rod.

19. The window air conditioner assembly of claim 17, wherein:

a support surface of the support rod that contacts the window air conditioner is non-planar; and a base plate of the window air conditioner includes a fitting part fitted with the support surface of the support rod.

* * * * *